US009500459B1

(12) United States Patent
Hoelscher

(10) Patent No.: US 9,500,459 B1
(45) Date of Patent: Nov. 22, 2016

(54) SAFING LOGIC AND FIRE SET SYSTEM WITH DUAL-MODE PULSE GATE DRIVER APPARATUS AND METHOD OF USE

(71) Applicant: LOCKHEED MARTIN CORPORATION, Bethesda, MD (US)

(72) Inventor: David Hoelscher, Arlington, TX (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 0 days.

(21) Appl. No.: 14/816,625

(22) Filed: Aug. 3, 2015

(51) Int. Cl.
*F42B 3/18* (2006.01)
*F42C 15/40* (2006.01)
*H03K 17/687* (2006.01)

(52) U.S. Cl.
CPC ..... *F42C 15/40* (2013.01); *H03K 17/687* (2013.01)

(58) Field of Classification Search
CPC ..... F42C 15/40; H03K 17/687
USPC ..... 102/202.1–202.14
See application file for complete search history.

(56) References Cited

U.S. PATENT DOCUMENTS

| | | | | |
|---|---|---|---|---|
| 3,733,555 | A * | 5/1973 | Marshall | G01M 7/08 327/105 |
| 4,372,212 | A | 2/1983 | Hoelzen et al. | |
| 5,534,814 | A | 7/1996 | Archer | |
| 5,542,334 | A | 8/1996 | Wells | |
| 5,936,188 | A | 8/1999 | Atkinson | |
| 6,940,189 | B2 | 9/2005 | Gizara | |
| 7,971,532 | B1 | 7/2011 | Olson et al. | |
| 8,587,362 | B2 | 11/2013 | Machida et al. | |
| 2013/0187684 | A1 | 7/2013 | Gangopadhya | |

* cited by examiner

*Primary Examiner* — Samir Abdosh
(74) *Attorney, Agent, or Firm* — Terry M. Sanks, Esq.; Beusse Wolter Sanks & Maire, PLLC

(57) ABSTRACT

Embodiments relate to safing logic and fire set systems with a dual-mode pulse gate driver device and method of use. An aspect includes a device for a circuit having a switch, the device comprising: a gate driver including a trigger input to receive a trigger signal to initiate a test of the circuit in a first mode or a pulse through the circuit to cause a pyrotechnic chain reaction in a second mode, a power supply input and an output for driving the switch in response to receiving the signal. The device includes a trickle charge capacitor coupled to the power supply input. The device includes a high impedance coupled to the capacitor and input power circuitry, the high impedance trickle charging the capacitor and preventing a high voltage through the switch from being applied to the power circuitry in the first mode for subsequent operation in the second mode.

20 Claims, 8 Drawing Sheets

SAFING LOGIC AND FIRE SET SYSTEM WITH DUAL-MODE PULSE GATE DRIVER APPARATUS AND METHOD OF USE

BACKGROUND

Embodiments relate to safing logic and fire set (SLFS) systems with a dual-mode pulse gate driver apparatus and method of use.

The use of high voltages can be found in a variety of integrated circuit applications including ignition safety devices (ISD), electronic safe and arming fuze (ESAF) or other pulse discharge applications. Missiles include an ignition safety device (ISD) to prevent the missiles from being inadvertently activated such as during transportation, storage or when handling the missile. However, missiles can be stored for years before there is a need to use such a missile. It is imperative for the safety of the public and workers handling such devices that the ISD operates flawlessly. ISDs are generally used to arm a rocket motor. On the other hand, the ESAF may be used to arm a warhead.

Missiles are manufactured for a single event application. However, for safety and maintenance such as after assembly or long term storage of a missile, such ISDs and ESAFs need to be tested.

SUMMARY

Embodiments relate to safing logic, and fire set (SLFS) systems with a dual-mode pulse gate driver device and method of use. An aspect of the embodiments include a device for use with a circuit having a switch, the device comprising: a gate driver including a trigger input to receive a trigger signal to initiate a test of the circuit in a first mode or a pulse through the circuit to cause a pyrotechnic chain reaction in a second mode, a power supply input and an output for driving the switch in response to receiving the trigger signal. The device includes a trickle charge capacitor coupled to the power supply input. The device includes a high impedance coupled to the trickle charge capacitor and input power circuitry, the high impedance trickle charging the trickle charge capacitor and preventing a high voltage through the switch from being applied to the input power circuitry in the first mode for subsequent operation in the second mode.

Another aspect of the embodiments includes a safing logic and fire set (SLFS) system comprising a safing logic and fire set (SLFS) circuit with a switch, the SLFS circuit coupled to input power circuitry and being configured to discharge a pulse through the switch. The system includes a dual-mode pulse driver device having a first mode to initiate a test of the circuit and a second mode to initiate a pyrotechnic chain through the circuit. The device comprises a gate driver including a trigger input to receive a trigger signal in the first mode or the second mode, a power supply input and an output for driving the switch in response to receiving the trigger signal; and a trickle charge capacitor coupled to the power supply input. The device includes a high impedance coupled to the trickle charge capacitor and the input power circuitry, the high impedance trickle charging the trickle charge capacitor and preventing a high voltage, through the switch, from being applied to the input power circuitry in response to the test.

Another aspect of the embodiments includes a method for testing a circuit having a switch comprising a switch input, the circuit configured to discharge a pulse through the switch and being coupled to input power circuitry, the method comprising: providing dual-mode pulse driver device comprising a gate driver including a trigger input to receive a test trigger signal to initiate a test of the circuit in a first mode or a pulse through the circuit to cause a pyrotechnic chain reaction in a second mode, a power supply input and an output for driving the switch in the circuit; a trickle charge capacitor coupled to the power supply input; and a high impedance coupled to the trickle charge capacitor and the input power circuitry; trickle charging the trickle charge capacitor via the high impedance; simultaneously during the charging of the trickle charge capacitor, charging a discharge capacitor in the circuit, triggering the gate driver for the test; the discharge capacitor discharging the pulse during the test; and preventing a high voltage through the switch from being applied to the input power circuitry in response to the test in the first mode for subsequent operation in the second mode.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION

Figure 1:
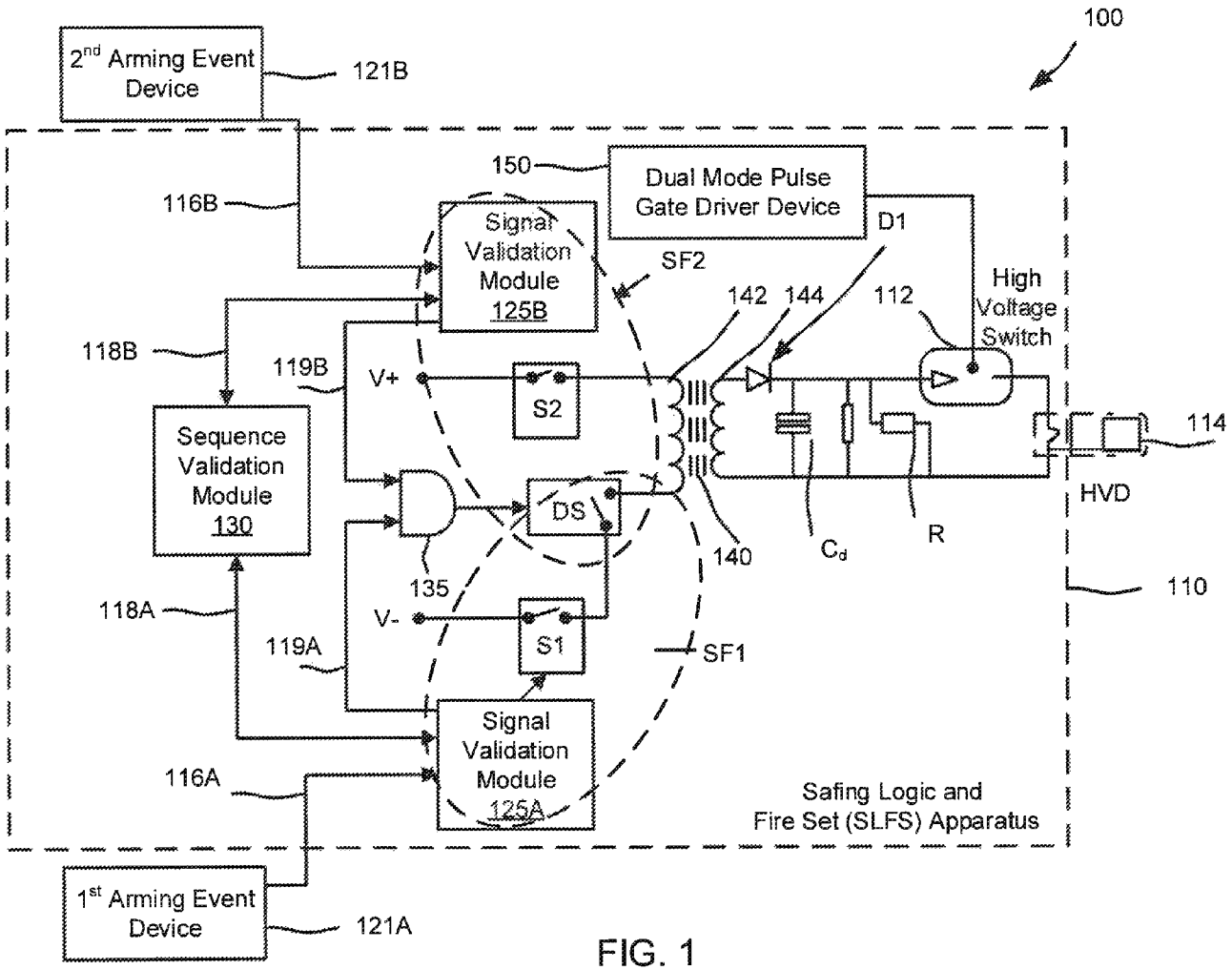
FIG. 1 illustrates a block diagram of a sating logic and fire set system.

Embodiments are described herein with reference to the attached figures wherein like reference numerals are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods in other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

FIG. 1 illustrates a block diagram of a safing logic and fire set (SLFS) system 100. It should be recognized that in practical applications, the SLFS system 100 may include many other components and features that have not been expressly illustrated in FIG. 1, which are not included herein for sake of brevity. The SLFS system 100 will be described in relation to an airborne vehicle 900 of FIG. 9. The SLFS system 100 may include an SLFS apparatus 110 having a high voltage switch (HVS) 112. The HVS 112 may be coupled to a high voltage device (HVD) 114. The SLFS 110 may include a first arming event input 116A. The SLFS apparatus 110 may include a second arming input 116B to initiate arming of a device associated with the vehicle 900, as will be described in more detail. The first arming event input 116A may be coupled to a first arming event device 121A. The second arming event input 116B may be coupled to a second arming event device 121B.

Figure 9:
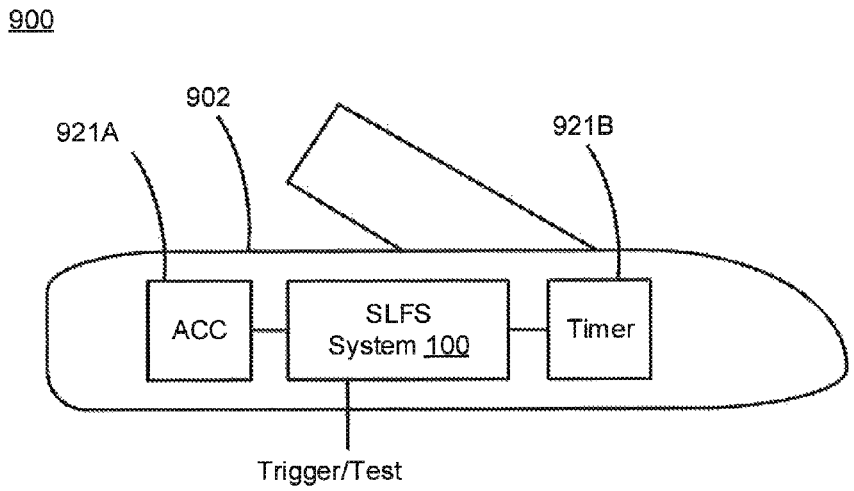
FIG. 9 illustrates an airborne vehicle with an ignition safety device system of FIG. 1.

The first arming event device 121A may include by way of non-limiting example, an accelerometer 921A. The first arming event device 121A may initiate arming when acceleration has reached a predetermined acceleration value associated with at least one known motion of an airborne vehicle 900 (FIG. 9). By way of non-limiting example, the second arming event input 116B may include a control signal from a timer 921B to initiate arming. The SLFS system 100 is supported by body 902 of the airborne vehicle 900. While the description herein is related to an airborne vehicle, the SLFS system 100 has application for other pulse charge applications including, but not limited to, camera technology, airbag technology and explosive detonation technologies. Explosive detonation technologies may include electronic safe arm and fuze (ESAF). In an embodiment, the SLFS apparatus 110 is an ESAF when used to detonate a warhead.

The SLFS apparatus 110 may include a first signal validation module 125A which may be coupled to a first switch S1. The SLITS apparatus 110 may include a second signal validation module 125B which may be coupled to a second switch S2. In an embodiment, the first switch S1 and the second switch S2 may be static switches. The SLFS apparatus 110 may include a sequence validation module 130. One side of switch S1 may be coupled to the voltage V−. The other side of switch S1 may be coupled to one input of the dynamic switch DS. One side of switch S2 may be coupled to voltage V+. The switch S1, via dynamic switch DS, and switch S2 may be coupled to transformer 140. The transformer 140 includes a primary winding 142 and a secondary winding 144.

The switch S2 may be coupled to the positive terminal of the primary winding 142 and switch S1, via dynamic switch DS, may be coupled to a negative terminal of the primary winding 142 wherein the voltage V+ and voltage V− are power inputs. The power inputs may serve as the transformer's primary winding voltage source.

The dashed circular area denoted as SF1 includes first signal validation module 125A, switch S1 and dynamic switch DS. The dashed circular area denoted as SF2 includes the second signal validation module 125B, switch S2 and dynamic switch DS.

The sequence validation module 130 may be coupled to the first signal validation module 125A and the second signal validation module 125B via control lines 118A and 118B, respectively. The sequence validation module 130 may include logic circuits or a computing device such as computing device 1070 of FIG. 10.

The first signal validation module 125A may include a first input from the first arming event input 116A and an input on control line 118A from sequence validation module 130. The first signal validation module 125A may be coupled to dynamic switch DS.

The second signal validation module 125B may include a first input from the second arming event input 116B and an input on control line 118B from sequence validation module 130. The second signal validation module 125B may be coupled to dynamic switch DS.

By way of non-limiting example, the first signal validation module 125A and the second signal validation module 125B may be coupled to the dynamic switch DS by a switch control 135 such as, without limitation, a logic gate. The first signal validation module 125A may be coupled to the switch control 135 via line 119A. The second signal validation module 125B may be coupled to the switch control 135 via line 119B.

In FIG. 1, the switch control 135 may include an AND gate. However, other logic gates may be used. The inputs to the AND gate include the outputs (i.e., lines 119A and 119B) from the first signal validation module 125A and the second signal validation module 125B. The output of the AND gate (switch control 135) is coupled to the dynamic switch DS. Based on the output of the AND gate, the switch state of the dynamic switch DS is controlled to switch between OPEN and CLOSED.

The dynamic switch DS may be part of a power converter to take low-voltage inputs to convert the low-voltage input into a high-voltage output. In operation, if both switches S1 and S2 are OFF, there is no initiation as no power (voltage) can be delivered to the primary winding 142 of transformer 140. In such a condition, the switches S1 and S2 are in an OPEN state such as shown in FIG. 1.

When conditions are sensed via the first signal validation module 125A and sequence validation module 130, switch S1 will switch to a CLOSED state by signal validation module 125A. When conditions are sensed via the second signal validation module 125B and sequence validation module 130, switch S2 will switch to a CLOSED state by signal validation module 125B.

The power from the primary winding 142 passes through the transformer 140 to the secondary winding 144. The positive terminal of the secondary winding 144 has coupled thereto diode D1. The diode D1 may include an anode side and a cathode side. The output of transformer 140 may be a high voltage to charge capacitor $C_d$ wherein capacitor $C_d$ is a discharge capacitor. The anode of the diode D1 may be coupled to the positive terminal of the secondary winding 144. One end of the discharge capacitor $C_d$ may be coupled to the cathode side of the diode D1. The other end the discharge capacitor $C_d$ may be coupled to the negative side of the secondary winding. At least one resistor R is couple in parallel with discharge capacitor $C_d$.

When switch S2 is in the CLOSED state, a path is created from V+ to transformer 140 to a top node of the dynamic switch DS. As a frame of reference, the top node being the node coupled to a bottom of the primary winding of the transformer 140. When switch S1 is in the CLOSED state, the path is created from V− to the bottom node of the dynamic switch DS. In an embodiment, current may ramp up to the secondary winding 144 of transformer 140.

In operation, when the SLFS apparatus 110 is armed, the discharge capacitor $C_d$ is charged to a high voltage. The HVS 112 when switched delivers a high voltage to the HVD 114 to cause a pyrotechnic chain reaction which may result in a blast of fire to start a warhead and/or rocket motor of the airborne vehicle 900. In an embodiment, the HVD 114 may comprise a foil initiator.

The configuration of the sequence validation module 130, the first signal validation module 125A and the second signal validation module 125B are arranged to prevent the inadvertent ignition of the SLFS apparatus 110. For missile applications, the SLFS apparatus 110 may control one or more functions of the airborne vehicle 900 (FIG. 9). By way of non-limiting example, the rocket motor should not go off inadvertently. The warhead should not be ignited in advertently. The SLFS apparatus 110 should prevent unintentional ignition due to unnatural effects such as, without limitation, electrostatic discharge. Furthermore, the airborne vehicle 900 needs to be deployed as needed on demand. Hence, from time to time the SLFS apparatus 110 needs to be tested to ensure that the airborne vehicle is fully operational.

The system 100 further includes a pulse gate driver device 150. The pulse gate driver device 150 may be configured to initiate generation of a high voltage/current pulse by driving the HVS. The pulse is at a rate which is faster than naturally occurring high voltage pulses which may explode a foil initiator of the HVD 114. The pulse gate driver device 150 may be a test pulse gate driver device 150. In an embodiment, the device 150 may be configured to conduct a test of the circuit configured to discharge a pulse such as SLFS apparatus 110 without damaging the circuitry of the circuit. Additionally, the device 150 may be used to cause the circuit (i.e., SLFS apparatus 110) to discharge a pulse to arm a warhead, start a motor or cause a pyrotechnic chain reaction.

The device 150 may have dual use in system 100. In a first mode, the device 150 may be used to initiate and perform a test using an inert load resistor (such as impedance Z20). In a second mode, the device 150 may be used to drive the HVS 112 to cause the pyrotechnic chain reaction for an ISD or ESAF technologies The SLFS apparatus 110 includes a semiconductor high voltage switch (HVS) 112 to pass a high voltage, high current pulse to initiate pyrotechnic chains for rocket motors and/or warheads. Turning on the HVS 112 requires a source of gate drive energy that continues to be applied for the duration of the pulse directed to the HVD 114.

The inventor has discovered that as the HVS 112 turns on, the gate driver power remains applied wherein the turn on transient that occurs causes the gate voltage to experience a common mode shift (e.g., 1200 V within 100 nanoseconds (ns)).

The inventor has determined that the bipolar high voltage ringing that follows when testing with an inert impedance, such as a resistive load, precludes the typical bootstrapped-capacitor solution that is commonly applied when turning on a high-side switch (i.e., HVS 112) in power converter applications.

In general, the circuit of the SLFS apparatus 110 may be configured for a single use event. However, with the addition of the dual-mode pulse gate driver device 150, the circuit can be tested without harm to the electronics. Furthermore, the testing protocol may employ an inert resistor or impedance with a waveform that has both positive and negative profiles. The device 150 may also be part of the circuit allowing for simultaneous testing of the circuit and device 150 embedded in the circuit.

The HVS 112 in FIG. 1 has three nodes. The first node is represented by the triangle element on the left side of the page. The second node is represented by the top dot. The third node is a voltage output from the HVS 112 to the HVD 114. The first node being a voltage input node. The second node being a switch control node. The HVS 112 has an OPEN state and a CLOSED state. The term OPEN may mean OFF and may be used interchangeably. CLOSED may mean ON and may be used interchangeably. In operation when the HVS 112 is in the OFF, the voltage at the input node may be approximately 1200V or some other high voltage parameter. The switch control node may have a voltage of approximately 15V. The voltage at the voltage output node may be approximately zero (0) V.

When the HVS 112 is switched ON by the output from the gate driver 460, the voltage at the input node flows to the voltage output node. The voltage may be at least 1200V, the voltage being the discharged voltage from discharging capacitor $C_d$ to cause the HDV 114 to break or generate a pyrotechnic chain reaction.

The dual-mode pulse gate driver device 150 will be described in more detail in relation to FIGS. 4-7. It should be recognized that in practical applications, the gate driver devices of FIGS. 4-7 may include many other components and features that have not been expressly illustrated in FIGS. 4-7, which are not included herein for sake of brevity.

Figure 4:
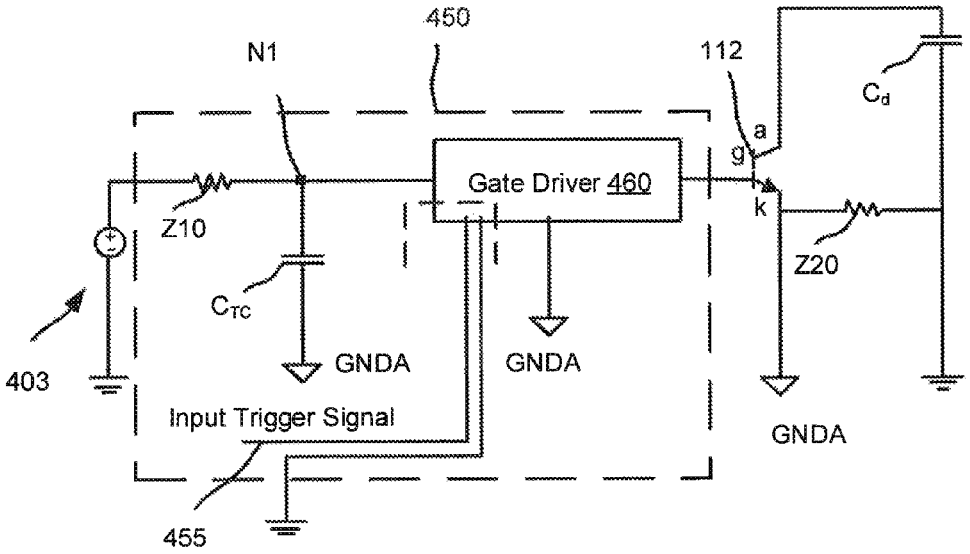
FIG. 4 illustrates a schematic diagram of a dual-mode pulse gate driver device.

FIG. 4 illustrates a schematic diagram of a gate driver device 450. The device 450 is configured to receive input from or may include a Direct Current (DC) supply of low voltage 403 (sometimes referred to as the "input power circuitry"). The DC supply of low voltage 403 is coupled to one side of a high impedance circuit Z10. The output of the high impedance circuit Z10 is coupled to node N1 where node N1 is coupled to one end of trickle charge capacitor $C_{TC}$ and a power or voltage input to a gate driver 460. In an embodiment, the gate driver 460 may be an isolated gate driver with a low quiescent current consumption. In an embodiment, the gate driver may have low quiescent current consumption of approximately 50 uA (microamps) or less. By way of non-limiting examples, the isolating device includes iCouplers, transformers, and fiber optics.

The other end of the trickle charge capacitor $C_{TC}$ is coupled to ground such as GNDA. The gate driver 460 may include a terminal coupled to ground such as GNDA. The gate driver 460 may include an input coupled to receive an input trigger signal 455. The gate driver 460 may include additional terminals coupled to ground or GNDA.

The output of the gate driver 460 may be coupled to the high voltage switch (HVS) 112 of the apparatus 110. The HVS 112 may be a semiconductor switch with a gate capacitance which may be approximately 100× (times) smaller than the trickle charge capacitor $C_{TC}$. In operation, the charging of the trickle charge capacitor $C_{TC}$ coincides with the charging of the high voltage discharge capacitor $C_d$. Thus, the trickle charge capacitor $C_{TC}$ is 100× (times) larger than the gate capacitance of the HVS 112.

Assume the HVS 112 is a semiconductor switch with a gate g, anode a and cathode k. The cathode k is coupled to ground GNDA. Additionally, the anode a is coupled to a discharge capacitor $C_d$. An impedance or resistor Z20 is coupled to the cathode and the other end of the discharge capacitor $C_d$ both of which may be coupled to ground. The impedance of resistor Z20 is a low impedance load (such as an inert load).

By way of non-limiting example, the high impedance circuit Z10 may have an impedance of 50 K ohms. The trickle charge capacitor $C_{TC}$ may be 100 nF (nanofarad). The discharge capacitor $C_d$ may be 150 nF with a high voltage greater than 1000V. The low impedance load Z20 may be approximately 0.1 ohms.

By way of non-limiting example, the HVS 112 may include a semiconductor switch. The semiconductor switch may be a metal-oxide semiconductor (MOS) field-effect transistor (FET) switch.

In FIG. 4, the HVS 112 is shown coupled to an impedance load Z20 in lieu of the HVD 114. The device 450 may also be used to test the circuit of the SLFS apparatus 110 by removing the HVD 114 and substituting the impedance load Z20. The circuit may include the dual-mode pulse gate driver device. While a resistor is shown, the impedance load Z20 should be commensurate with the test procedure and pulse application.

The device 450 may trickle charge a capacitor (i.e., trickle charge capacitor $C_{TC}$) through a high impedance circuit Z0 to withstand a high voltage. The trickle charging may occur simultaneously with the charging of the high voltage discharge capacitor $C_d$ such that no delay is created or introduced. The gate driver 460 may have very low quiescent current consumption (meaning current consumption of the gate driver 460 is substantially smaller than the trickle charge current) to ensure sufficient steady-state gate voltage is available at HVS 112. For example, low quiescent current consumption may result in a voltage drop which is proximately 10% of the input power voltage (i.e., voltage source 403, 503, 603).

Figure 2:
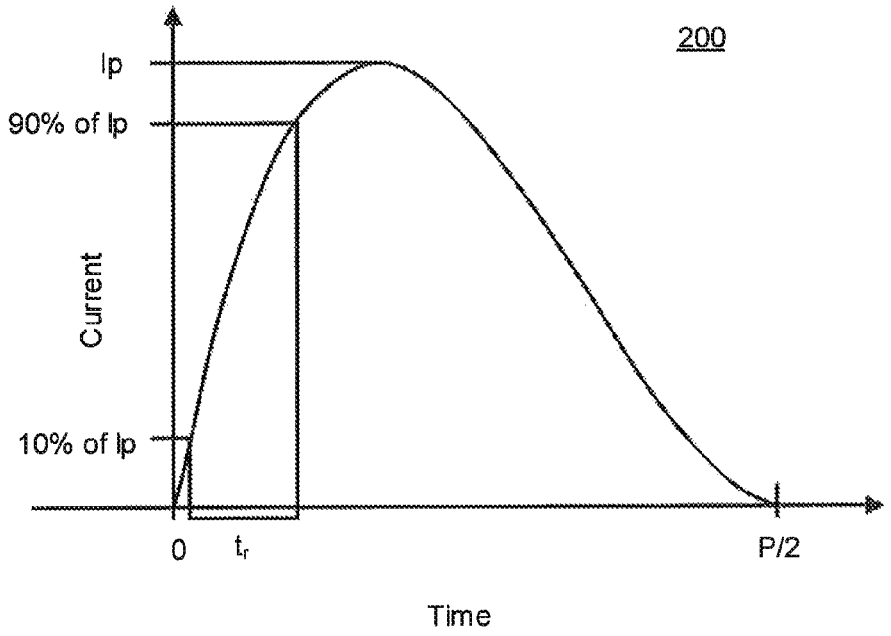
FIG. 2 illustrates a graphical representation of an actual load profile.

By sizing the trickle charge capacitance $C_{TC}$ to be approximately 100 times larger than the gate capacitance of the HVS 112, sufficient gate voltage is maintained during the pulse application through the HVS 112. In other words, the HVS 112 is maintained in a CLOSED state for a duration that allows the pulse to pass to the HVD 114. The pulse profile is shown in FIG. 2. During the pulse, while the gate driver capacitor (internal to the HVS) experiences a common mode shift at high voltage levels, the high impedance circuit Z10 used to trickle charge to the trickle charge capacitor $C_{TC}$ prevents the high voltage from being applied to the input power circuitry 403, thus preserving the input power circuitry 403 for use after the testing of the SLFS apparatus 110. The input power circuitry 403 also provides V+ and V− to the SLFS apparatus 110.

In an embodiment, the device 450 may only use surface-mount components which requires very little circuit board area.

Figure 5:
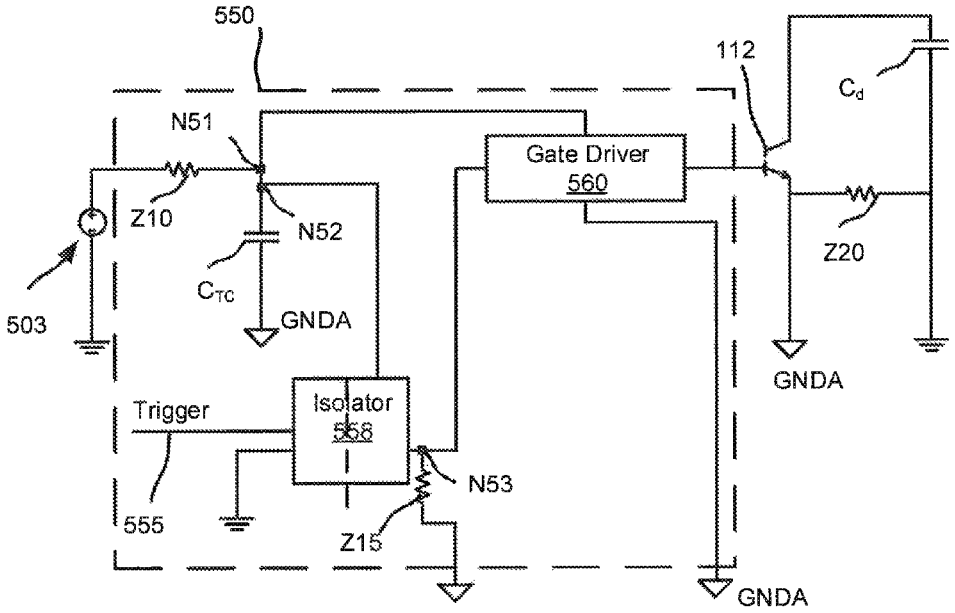
FIG. 5 illustrates a schematic diagram of another dual-mode pulse gate driver device.

FIG. 5 illustrates a schematic diagram of another gate driver device 550. The device 550 is similar to device 450, thus the differences will be described. Certain values in device 450 may be used in device 550.

The device 550 is configured to receive input from or may include a Direct Current (DC) supply of low voltage 503. The DC supply of low voltage 503 is coupled to one side of a high impedance circuit Z10. The output of the high impedance circuit Z10 is coupled to node N51 where node N51 is coupled to node N52 wherein node N52 may be coupled to one end of trickle charge capacitor $C_{TC}$. Node N51 is also coupled to a power or voltage input to a gate driver 560. In an embodiment, the gate driver 560 may be a gate driver with a low quiescent current consumption.

The other end of the trickle charge capacitor $C_{TC}$ is coupled to ground such as GNDA. The gate driver 560 may include a terminal coupled to ground such as GNDA. The gate driver 560 may include an input coupled to receive an input trigger signal. The gate driver 560 may include additional terminals coupled to ground or GNDA.

The device 550 further includes an isolator 558 such as an opto-isolator or opto-coupler. The isolator 558 has one input coupled to receive the trigger signal 555 from a device (NOT SHOWN) isolated from the gate driver 560. The isolator 558 is coupled to and receives power from node N52. The output of the isolator 558 is coupled to node N53 wherein node N53 is coupled to an input of the gate driver 560. The isolator 558 to transfer the trigger signal to the gate driver 560. At node N53, one end of an impedance Z15 may be coupled to node N53. The other end of the impedance Z15 may be coupled to a ground terminal such as GNDA.

The output of the gate driver 560 may be coupled to the high voltage switch (HVS) 112 of the apparatus 110. In an embodiment, the HVS 112 may be a metal-oxide semiconductor (MOS)-controlled thyristor (MCT) switch. The MCT switch may include a gate, drain and source configuration. The gate capacitance of an MCT switch may be approximately 1-2 nF (nanofarad).

Figure 6:
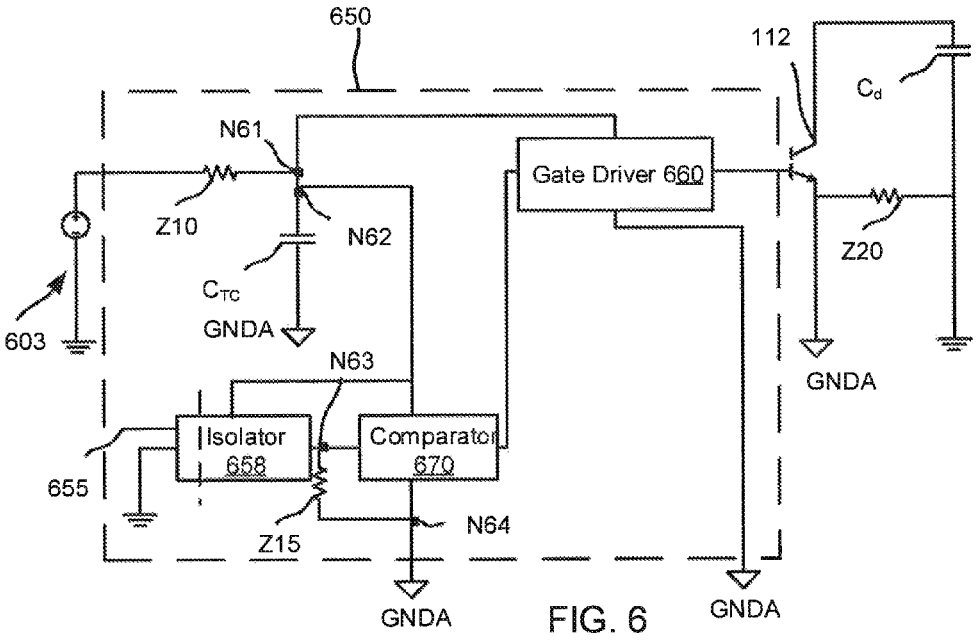
FIG. 6 illustrates a schematic diagram of yet another dual-mode pulse gate driver device.

FIG. 6 illustrates a schematic diagram of yet another gate driver device 650. The device 650 is similar to devices 450 and 550, thus the differences will be described. Certain values in device 450 and 550 may be used in device 650.

The device 650 is configured to receive input from or may include a Direct Current (DC) supply of low voltage 603. The DC supply of low voltage 603 is coupled to one side of a high impedance circuit Z10. The output of the high impedance circuit Z10 is coupled to node N61 where node N61 is coupled to node N62 wherein node N62 may be coupled to one end of trickle charge capacitor $C_{TC}$. Node N61 is also coupled to a power or voltage input to a gate driver 660. In an embodiment, the gate driver 660 may be an isolated gate driver with a low quiescent current consumption.

The other end of the trickle charge capacitor $C_{TC}$ is coupled to ground such as GNDA. The gate driver 660 may include a terminal coupled to ground such as GNDA. The gate driver 660 may include an input coupled to receive an input trigger signal 655 via isolator 658 and comparator 670, as will be describe in more detail. The gate driver 660 may include additional terminals coupled to ground or GNDA.

The device 650 further includes an isolator 658 such as an opto-isolator or opto-coupler. The isolator 658 has one input coupled to receive the trigger signal 655. An output of the isolator 658 is coupled to an input of comparator 670.

The comparator 670 may receive power from node N62. The output of the isolator 658 is coupled to node N63 wherein node N63 is coupled to an input of the comparator 670. At node N63, one end of an impedance Z15 may be coupled to node N63. The other end of the impedance Z15 may be coupled to a ground terminal such as GNDA. Between the isolator 658 and comparator 670 there is a node N63. Node N63 may have one end of impedance Z15 coupled thereto. Another end of impedance Z15 is coupled to a ground terminal such as GNDA.

The comparator 670 receives the trigger signal from isolator 658 and compares the trigger signal to a threshold to determine if a valid trigger signal has been received. If a valid trigger signal has been received, the comparator 670 outputs a voltage pulse indicative of trigger signal. If the trigger signal from the isolator 658 is determined to be a non-valid trigger signal, then the comparator 670 does not produce a voltage pulse indicative of a trigger signal.

The output of the gate driver 660 may be coupled to the high voltage switch (HVS) 112 of the apparatus 110.

Figure 7:
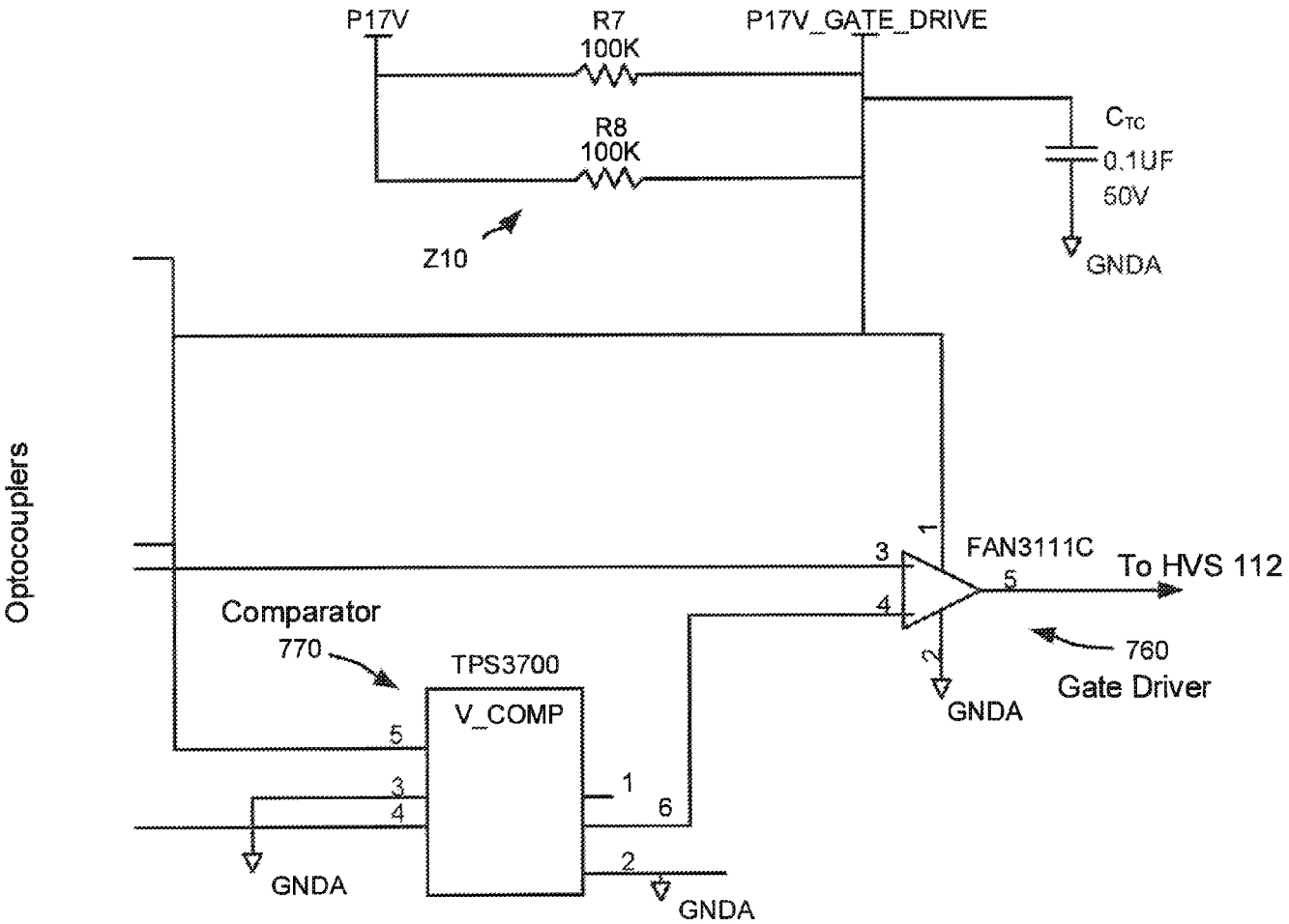
FIG. 7 illustrates another schematic diagram of the dual-mode pulse gate driver device of FIG. 6.

FIG. 7 illustrates another schematic diagram of the gate driver apparatus of FIG. 6. In the schematic diagram, the gate driver 760 may include a FAN3111C single, 1A High-Speed, Low-Side Gate Driver, manufactured by Fairchild Semiconductor Corporation. The high impedance circuit Z10 comprises a plurality of parallel resistors R7 and R8. Resistors R7 and R8 may each be 100 Kilo-Ohms. The comparator 770 is a TPS3700 manufactured by Texas Instruments Incorporated.

FIG. 2 illustrates a graphical representation of an actual load profile 200. The load profile 100 represents an actual load profile after the discharging capacitor $C_d$ is discharged. The vertical or y axis represents the current while the horizontal or x axis represents Time. Ip represents the peak current. The rise time for the current to ramp up is $t_r$. The rise time $t_r$ represents the amount of time the current raises from 10% of the peak current Ip to 90% of the peak current Ip. In an embodiment, the actual load profile 200 stops at zero amps and does not include a negative waveform profile. The value P/2 represents half of a period.

The peak current Ip represents that the amount of current to turn a foil initiator of the HDV 114 into a plasma state. The actual load profile 200 ramps up rapidly as represented by $t_r$ to reach the peak value in a predetermined time period.

Figure 3:
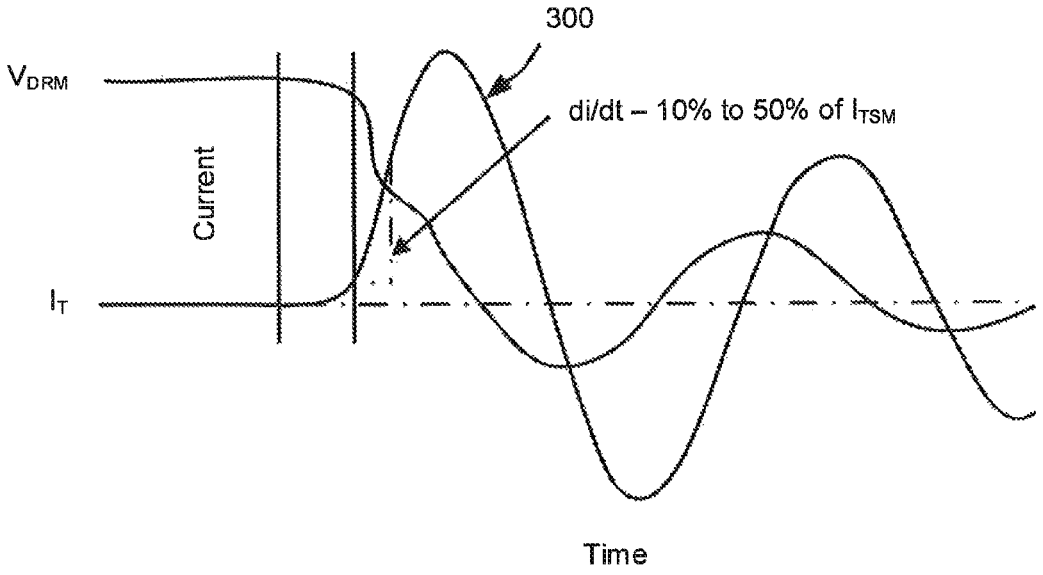
FIG. 3 illustrates a graphical representation of an inert/test load profile.

FIG. 3 illustrates a graphical representation of an inert/test load profile 300. The inert/test load profile 300. The waveform $I_T$ represents the test current and may include a positive and negative voltage swing. The positive portion of the $I_T$ waveform is similar to the actual load profile 100 for the positive portion of the waveform $I_T$. In the graph, the time to raise the current $I_T$ from 10% to 50% is represented in the dashed lines. There is a voltage $V_{DRM}$ waveform is overlaid in the graphical representation. The current $I_{TSM}$ represents the current from the HVS 112. $V_{DRM}$ may be the voltage of the discharge capacitor $C_d$ when charged.

The inert/test load profile is a function of the impedance Z20 or a resistor wherein while the current decays, the profile does not stop at zero (0) amps. Instead, the profile travels in a generally sinusoidal-type waveform which travels positive and then negative while decaying over time. The impedance Z20 will demonstrate a periodicity plus and minus and decay over time.

As can be appreciated, in FIG. 2, the profile 200 stops as a result of the HVD 114 opening or bursting. Thus, the current is represented as halted at zero over amps time P/2.

Figure 8:
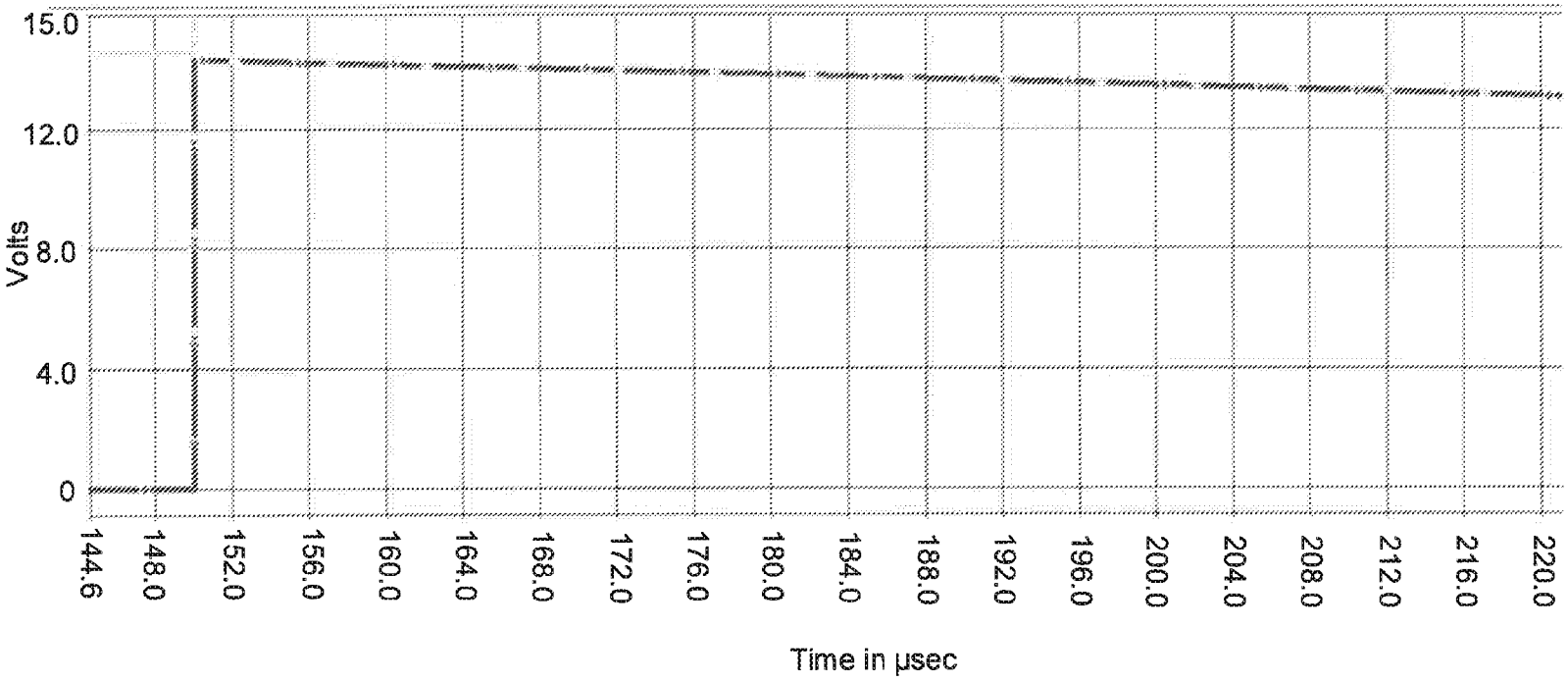
FIG. 8 illustrates a graphical representation of the voltage drop of the trickle charge capacitor over time after triggering.

FIG. 8 illustrates a graphical representation of the voltage drop of the trickle charge capacitor after trigger of the HVS 112 over time. The graphical representation illustrates approximately a two-volt (2V) drop after trigger of the HVS 112 by the pulse gate driver device 150.

Figure 11:
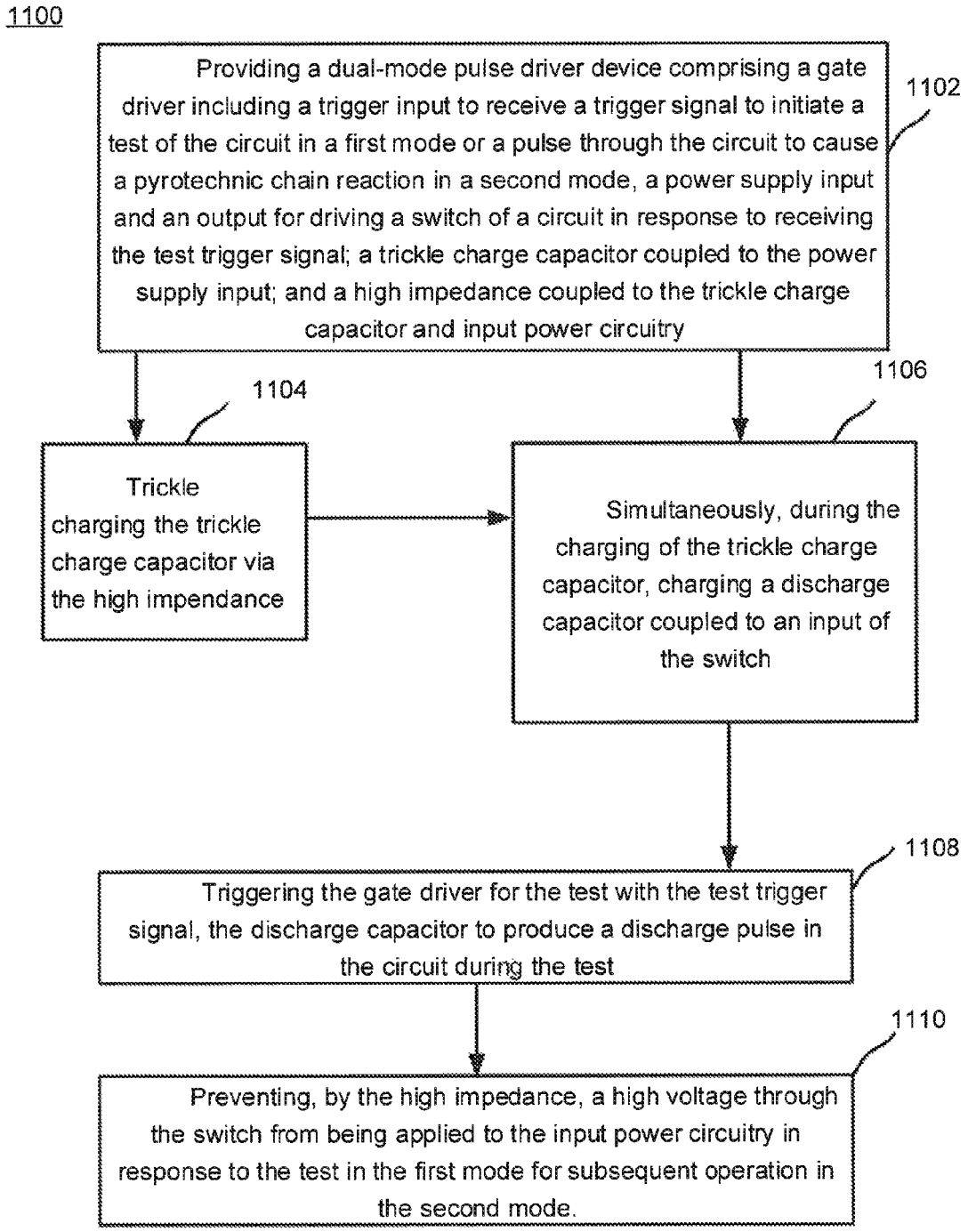
FIG. 11 illustrates a process for testing a circuit configured to discharge a pulse.

FIG. 11 illustrates a process 1100 for testing a circuit configured to discharge a pulse. The process 1100 may test a circuit having a switch comprising a switch input. The circuit may be configured to discharge a pulse through the switch and is coupled to input power circuitry. At block 1102, the process includes providing a dual-mode pulse driver device comprising a gate driver including a trigger input to receive a test trigger signal to initiate a test of the circuit in a first mode or a pulse through the circuit to cause a pyrotechnic chain reaction in a second mode, a power supply input and an output for driving the switch in the circuit; a trickle charge capacitor coupled to the power supply input; and a high impedance coupled to the trickle charge capacitor and the input power circuitry. At block 1104, the process includes trickle charging the trickle charge capacitor via the high impedance. At block 1106, the process includes simultaneously during the charging of the trickle charge capacitor, charging a discharge capacitor in the circuit. At block 1108, the process includes triggering the gate driver for the test in the first mode, the discharge capacitor discharging the pulse during the test. At block 1110, the process includes preventing a high voltage through the switch from being applied to the input power circuitry in response to the test or discharge of the voltage pulse or current through the switch.

The process 1100 can be used for testing the circuit or for the operation of the circuit to cause the actual discharge of the pulse such as, without limitation, to cause a pyrotechnic chain reaction. One or more of the blocks of process 1100 may be performed simultaneously or contemporaneously. Furthermore, one or more steps may be omitted or additional steps added.

Figure 10:
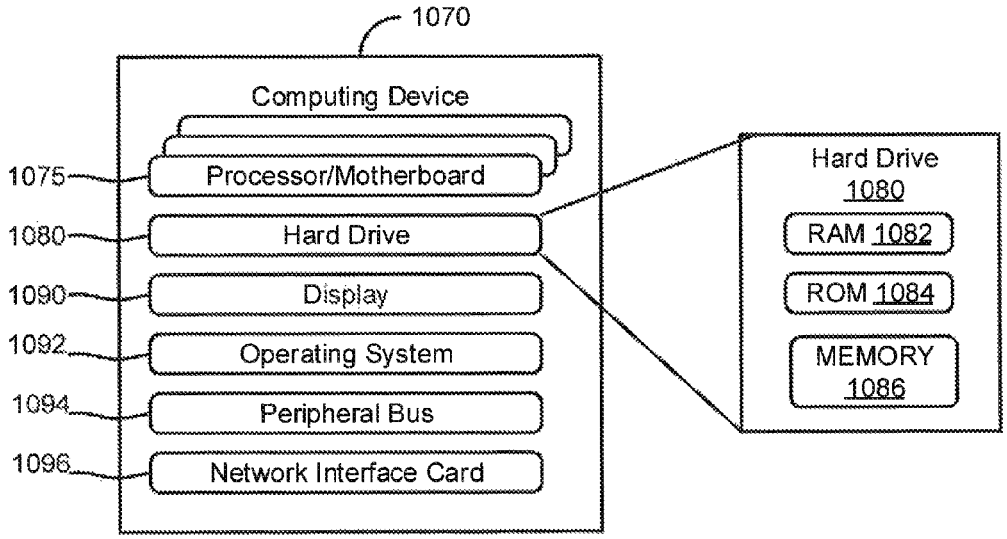
FIG. 10 illustrates a block diagram of a computing device.

Referring now to FIG. 10, in a basic configuration, the computing device 1070 may include any type of stationary computing device or a mobile computing device. Computing device may include at least one processor 1075 and system memory in hard drive 1080. Depending on the exact configuration and type of computing device, system memory may be volatile (such as RAM 1082), non-volatile (such as read only memory (ROM 1084), flash memory 1086, and the like) or some combination of the two. System memory may store operating system 1092, one or more applications, and may include program data for performing one or more processes or steps for sequence validation, testing or pulse discharge. Computing device 1070 may also have additional features or functionality such as for flying and navigating the airborne vehicle 900 and/or the control of the SLFS system 100.

The computing device 1070 may also include additional data storage devices (removable and/or non-removable) such as, for example, magnetic disks, optical disks, or tape. Computer storage media may include volatile and non-volatile, non-transitory, removable and non-removable media implemented in any method or technology for storage of data, such as computer readable instructions, data structures, program modules or other data. System memory, removable storage and non-removable storage are all examples of computer storage media. Computer storage media includes, but is not limited to, RAM, ROM, Electrically Erasable Read-Only Memory (EEPROM), flash memory or other memory technology, compact-disc-read-only memory (CD-ROM), digital versatile disks (DVD) or other optical storage, magnetic cassettes, magnetic tape, magnetic disk storage or other magnetic storage devices, or any other physical medium which can be used to store the desired data and which can be accessed by computing device. Any such computer storage media may be part of device.

Computing device 1070 may also include or have interfaces for input device(s) (not shown) such as a keyboard, mouse, pen, voice input device, touch input device, etc. The computing device 1070 may include or have interfaces for connection to output device(s) such as a display 1090, speakers, printer, etc. The computing device 1070 may include a peripheral bus 1094 for connecting to peripherals. Computing device 1070 may contain communication connection(s) that allow the device to communicate with other computing devices, such as over a network or a wireless network. By way of example, and not limitation, communication connection(s) may include wired media such as a wired network or direct-wired connection, and wireless media such as acoustic, radio frequency (RF), infrared and other wireless media. The computing device 1070 may include a network interface card 1096 to connect (wired or wireless) to a network.

Computer program code for carrying out operations of the invention described above may be written in a high-level programming language, such as C or C++, for development convenience. In addition, computer program code for carrying out operations of embodiments described herein may also be written in other programming languages, such as, but not limited to, interpreted languages. Some modules or routines may be written in assembly language or even micro-code to enhance performance and/or memory usage. It will be further appreciated that the functionality of any or all of the program modules may also be implemented using discrete hardware components, one or more application specific integrated circuits (ASICs), or a programmed Digital Signal Processor (DSP) or microcontroller. A code in which a program of the embodiments is described can be included as a firmware in a RAM, a ROM and a flash memory. Otherwise, the code can be stored in a tangible computer-readable storage medium such as a magnetic tape, a flexible disc, a hard disc, a compact disc, a photo-magnetic disc, a digital versatile disc (DVD).

The embodiments may be configured for use in a computer or a data processing apparatus which includes a memory, such as a central processing unit (CPU), a RAM and a ROM as well as a storage medium such as a hard disc.

Unless otherwise defined, all terms (including technical and scientific terms) used herein have the same meaning as commonly understood by one of ordinary skill in the art to which embodiments of the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In particular, unless specifically stated otherwise as apparent from the discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such data storage, transmission or display devices.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another.

While various disclosed embodiments have been described above, it should be understood that they have been presented by way of example only, and not limitation. Numerous changes, omissions and/or additions to the subject matter disclosed herein can be made in accordance with the embodiments disclosed herein without departing from the spirit or scope of the embodiments. Also, equivalents may be substituted for elements thereof without departing from the spirit and scope of the embodiments. In addition, while a particular feature may have been disclosed with respect to only one of several implementations, such feature may be combined with one or more other features of the other implementations as may be desired and advantageous for any given or particular application. Furthermore, many modifications may be made to adapt a particular situation or material to the teachings of the embodiments without departing from the scope thereof.

Therefore, the breadth and scope of the subject matter provided herein should not be limited by any of the above explicitly described embodiments. Rather, the scope of the embodiments should be defined in accordance with the following claims and their equivalents.

I claim:

1. A device for use with a circuit having a switch, the device comprising:

a gate driver including a trigger input to receive a trigger signal to initiate a test of the circuit in a first mode or a pulse through the circuit to cause a pyrotechnic chain reaction in a second mode, a power supply input and an output for driving the switch in response to receiving the trigger signal;

a trickle charge capacitor coupled to the power supply input; and a high impedance coupled to the trickle charge capacitor and input power circuitry, the high impedance trickle charging the trickle charge capacitor and preventing a high voltage through the switch from being applied to the input power circuitry in the first mode for subsequent operation in the second mode.

2. The device of claim 1, wherein the gate driver is isolated.

3. The device of claim 2, further comprising an opto-isolator having an input configured to receive the trigger signal and an output coupled to the trigger input of the gate driver.

4. The device of claim 1, wherein a capacitance of the trickle charge capacitor is 100 times larger than a gate capacitance of the switch.

5. The device of claim 1, wherein a current consumption of the gate driver is less than current consumption of the trickle charge capacitor to generate a steady-state voltage from the gate driver to the switch.

6. The device of claim 1, wherein the circuit is coupled to the input power circuitry.

7. The device of claim 1, wherein the switch includes an input and the circuit includes a discharge capacitor coupled to the input of the switch and configured to discharge a pulse; and wherein charging of the discharge capacitor and the trickle charge capacitor coincide.

8. A safing logic and fire set (SLFS) system comprising:

a safing logic and fire set (SLFS) circuit with a switch, the SLFS circuit coupled to input power circuitry and being configured to discharge a pulse through the switch; and a dual-mode pulse driver device having a first mode to initiate a test of the circuit and a second mode to initiate a pyrotechnic chain through the circuit, the device comprising:

a gate driver including a trigger input to receive a trigger signal in the first mode or the second mode, a power supply input and an output for driving the switch in response to receiving the trigger signal;

a trickle charge capacitor coupled to the power supply input; and a high impedance coupled to the trickle charge capacitor and the input power circuitry, the high impedance trickle charging the trickle charge capacitor and preventing a high voltage, through the switch, from being applied to the input power circuitry in response to the test.

9. The system of claim 8, wherein the gate driver is isolated.

10. The system of claim 9, wherein the dual-mode pulse driver device further comprising an opto-isolator having in input configured to receive the test trigger signal and an output coupled to the trigger input of the gate driver.

11. The system of claim 8, wherein a capacitance of the trickle charge capacitor is 100 times larger than a gate capacitance of the switch.

12. The system of claim 8, wherein a current consumption of the gate driver is less than current consumption of the trickle charge capacitor to generate a steady-state voltage from the gate driver to the switch.

13. The system of claim 8, wherein the switch includes a switch input and the circuit includes a discharge capacitor coupled to the switch input; and wherein charging of the discharge capacitor and the trickle charge capacitor coincide.

14. The system of claim 8, wherein the switch is a high voltage switch and the pulse to the switch is at least 1000 Volts.

15. The system of claim 14, wherein the pulse is 1200 Volts.

16. A method for testing a circuit having a switch comprising a switch input, the circuit configured to discharge a pulse through the switch and being coupled to input power circuitry, the method comprising:

providing a dual-mode pulse driver device comprising a gate driver including a trigger input to receive a trigger signal to initiate a test of the circuit in a first mode or a pulse through the circuit to cause a pyrotechnic chain reaction in a second mode, a power supply input and an output for driving the switch in the circuit; a trickle charge capacitor coupled to the power supply input; and a high impedance coupled to the trickle charge capacitor and the input power circuitry;

trickle charging the trickle charge capacitor via the high impedance;

simultaneously during the charging of the trickle charge capacitor, charging a discharge capacitor in the circuit;

triggering the gate driver for the test, the discharge capacitor discharging the pulse during the test; and preventing a high voltage through the switch from being applied to the input power circuitry in response to the test in the first mode for subsequent operation in the second mode.

17. The method of claim 16, further comprising:

receiving, by an opto-isolator, the test trigger signal; and communicating, by the opto-isolator, the received test trigger signal to the gate driver.

18. The method of claim 16, wherein a capacitance of the trickle charge capacitor is 100 times larger than a gate capacitance of the switch.

19. The method of claim 16, wherein during the test, current consumption of the gate driver is less than current consumption of the trickle charge capacitor to generate a steady-state voltage from the gate driver to the switch.

20. The method of claim 16, wherein the switch is a high voltage switch and the pulse discharge applied to the switch is at least 1000 Volts.

* * * * *